United States Patent [19]

Negreiros

[11] 3,969,028

[45] July 13, 1976

[54] DRAWING AND WRITING BRUSH-PEN WITH ROUND AND FLAT HAIR AND ADJUSTABLE FLOW OF PERMANENT LIQUID INK

[76] Inventor: Salvio Correia Lima Negreiros, Rua Marques de Olinda 90 No. 43, Rio de Janeiro, Brazil

[22] Filed: July 11, 1974

[21] Appl. No.: 487,637

[30] Foreign Application Priority Data

July 12, 1973 Brazil ..... 5194

[52] U.S. Cl. ..... 401/279

[51] Int. Cl. ..... A46b 11/04

[58] Field of Search ..... 401/270, 279, 4, 278, 401/280

[56] References Cited

UNITED STATES PATENTS

| | | | |
|---|---|---|---|
| 862,630 | 8/1907 | Garvey et al. | 401/279 X |
| 965,075 | 7/1910 | Cardinet | 401/270 X |
| 1,063,020 | 5/1913 | Ellis | 401/279 X |
| 1,253,934 | 1/1918 | Busch | 401/4 |
| 1,572,362 | 2/1926 | Rapisardi | 401/279 X |
| 2,331,672 | 10/1943 | Falkman | 401/278 |

*Primary Examiner*—Lawrence Charles

*Attorney, Agent, or Firm*—Burns, Doane, Swecker & Mathis

[57] ABSTRACT

Brush-pen of round and flat hair and permanent liquid ink of adjustable flow for drawing and writing, including a container on the upper part of the outer body of the ferrule. This container is provided with a cap with a controlling device, into which the desired liquid ink is introduced. The ink goes through an orifice of the upper part of an outer cylinder of the ferrule and through a winged guide cap of an inner cylinder of the ferrule. The inner cylinder contains a piston provided with a pressure shaft controlled by the controlling device of the cap so as to provide adjustment of the passage of ink through a hollow needle of the ferrule. This maintains a constant flow of ink to the hair (brush) tip in the desired amount, doing without the need of inkpots. The alternating downwards and upwards movement of the piston keeps the channel constantly clean.

8 Claims, 6 Drawing Figures

DRAWING AND WRITING BRUSH-PEN WITH ROUND AND FLAT HAIR AND ADJUSTABLE FLOW OF PERMANENT LIQUID INK

BACKGROUND OF THE INVENTION

The present invention relates to a brush-pen of round and flat hair with an ink container in the upper part feeding the hair tip. This container is supplied with a mechanism which adjusts, as desired, the amount of ink released, allowing continuous drawing and writing and doing without the inkpot.

DETAILED DESCRIPTION

Figure 2:
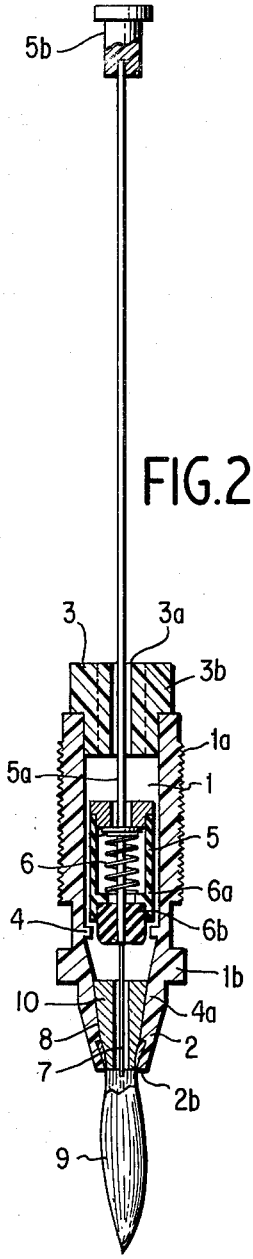

As can be seen in the drawings, FIG. 2, the interior body of the ferrule is made up of a hollow cylinder 1 with an external thread 1*a*. The hollow cylinder 1 is provided with an intermediate, outwardly extending, circumferential flange 1*b* and, beneath flange 1*b*, is provided with a slightly cone-shaped tip 2. The upper part of the cylinder 1 contains a cap 3 comprising three or more wings 3*b* extending outwardly from a cylindrical, hollow central tube 3*a*. The wings engage the inner wall of the hollow cylinder 1, and the central tube 3*a* provides a guide for a shaft 5*a* extending therethrough. The wings thereby centralize the cap 3 and the central tube 3*a* with respect to the cylinder 1 while providing for the passage of ink therethrough.

The inner body of the cylinder 1 is straight along most of its length with an inwardly extending, circumferential flange or ring 4 slightly above a cone-shaped inner portion 4*a*. The cone shaped portion 4*a* extends down to a lower end 2*b* of the hollow cylinder 1.

Figure 1:
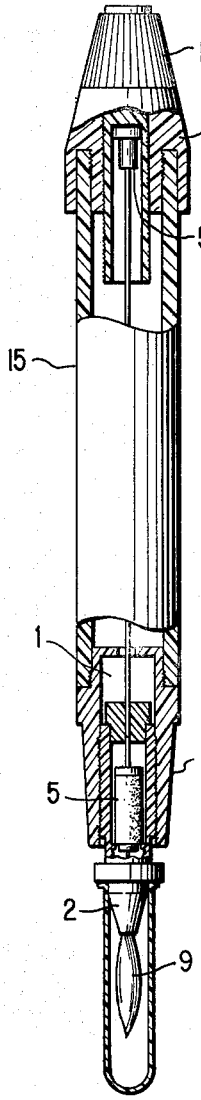
FIG. 1 is a view in cross-section of the assembled brush-pen set, revealing its interior mechanism; and, FIGS. 2, 3, 4, 5 and 6 are enlarged views in cross-section showing components of the brush-pen set of FIG. 1 separately and in detail, as well as their functions in the set of FIG. 1.

There is, within the central hollow cylinder 1, a smaller cylindrical piston 5 through which the shaft 5*a* extends upwardly and through the central tube 3*a* of the cap 3. The shaft 5*a* is provided with a headed part 5*b* at the upper end thereof and extends into the cap of the brush-pen as can be seen from the assembly drawing of FIG. 1. The piston 5 is hollow and has an expansion spring 6 disposed therein. The spring 6 has an upper end fixed or connected to the shaft 5*a* in a suitable manner and the lower end of the spring 6 is seated on a peripheral abutment or inwardly projecting flange or ring 6*a* on the wall of the piston 5. The shaft 5*a* extends through the piston 5 and is connected to a movable stopper 6*b*, from the lower side of which extends a filament 7. The stopper 6*b* moves downwards when the shaft 5*a* is moved downward by rotation of the cap 19 of the brush-pen. When the stopper 6*b* is moved downwardly, the shaft 5*a* is pressed downwardly on to the spring 6 compressing it against the abutment 6*a* of the hollow piston 5 and the shaft 5*a* and the stopper 6*b* are thus biased upwardly with the shaft biased into pressure contact with the cap so as to move upwardly as the pressure applied by the cap is removed. The piston 5 may move upwards to the upper cap 3 and downwards to the lower flange or abutment 4, when the brush-pen is shaken by the operator.

There is, fixed on the cone-shaped tip 2, a ferrule 8 with hair (brush) tip 9 which begins slightly below the lower part of the movable stopper 6*b* and ends at the cone-shaped tip 2*b* of the outer cylinder. The ferrule 8 is provided with a hollow passage 10 therethrough which communicates with the hair (brush) tip 9 at its upper end. The filament 7 connected to the lower part of the stopper 6*b* penetrates the passage 10 of the ferrule 8 through to the end thereof.

Figure 3:
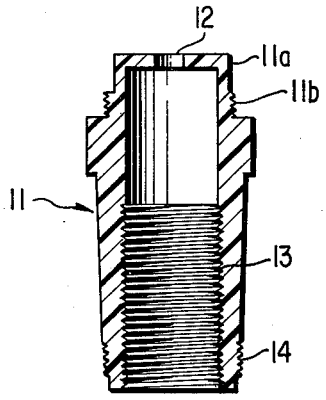

The outer body of the ferrule, FIG. 3, is made up of a hollow cylinder 11, having on its upper part a smooth top 11*a* of smaller diameter with a thread on its base as indicated at 11*b*. This thread has a central orifice 12 connected with the interior of the cylinder 11. Half of the lower part of this cylinder is supplied with threads 13. The outer body of the ferrule is threaded on its lower part 14.

Figure 4:
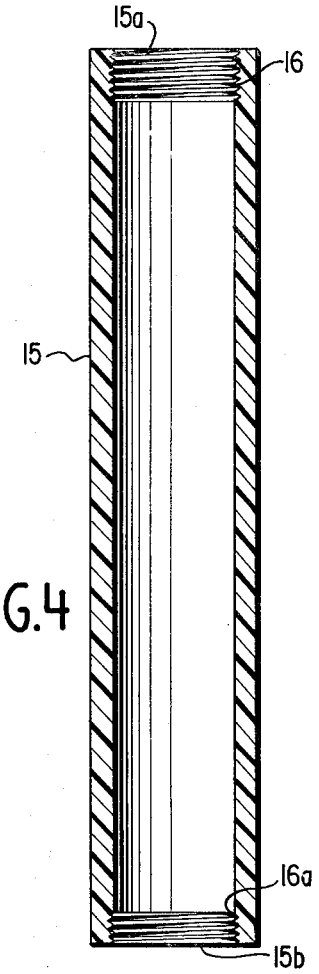
Figure 5:
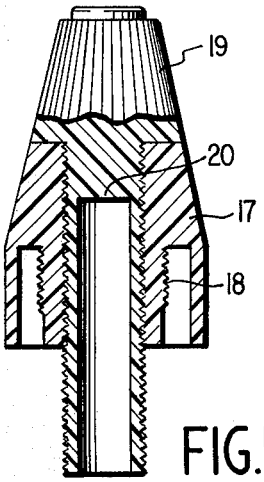

The inner body, FIG. 3, is screwed to the inner part FIG. 2, of the ferrule, along with the shaft 5*a* which goes through the central orifice 2 penetrating through the ink container, FIG. 4, fitting the head 5*b* in the hollow cylinder of the cap, FIG. 5.

The ink container, FIG. 4, is made up of a hollow cylinder 15 open on both sides 15*a*, 15*b* and threaded on the upper and lower inner extremities 16 and 16*a*, respectively. The lower extremity 16*a* is screwed on the smooth top of smaller diameter 11*a* of the outer body of the ferrule (FIG. 3).

The cap of the ink container, FIG. 5, comprises a cone including two parts. A lower part 17 is hollow and threaded on its base 18. An upper part of the cone and regulator of the flow of ink is made up of a head 19 attached to a hollow threaded cylinder 20. This cap is threaded on the upper part of the ink container, FIG. 4.

Figure 6:
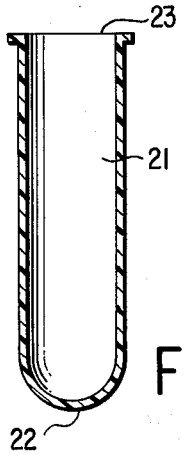

The cap protecting the hair (brush) tip, FIG. 6, is made up of a smaller hollow cylinder 21 with one of its round extremities closed 22 and the other one open 23. Through pressure, it can be encased on the external cone shaped tip 2 (FIG. 2) so as to protect the hair (brush) tip against eventual damage and so as to avoid drying up of the ink.

In operation, turning the cap 19 (FIGS. 1 and 5) clockwise, counterclockwise the flow of ink is adjusted through the pressure exerted on the shaft 5*a* by the cylinder 20 of the cap 19, which in turn pushes the stopper 6*b* down, opening or closing the ink passage through the passage 10 which crosses the ferrule 8, feeding the brush 9. Specifically, downward movement of the stopper 6*b* restricts the passage of ink to the brush 9 and completely stops the flow of ink to the brush when the stopper is in contact with the ferrule 8.

The ink flows from its container through the passages between the wings constituting the cap 3 filling the hollow cylinder 1. It then flows between the inner wall of the cylinder 1 and the outer wall of the piston 5. Shaking by the operator will liberate clogging of the ink between the walls by the reciprocating movement of the piston 5 against the relatively light action of the spring 6. From this passage between the walls, the ink flows down through the peripheral passages and the abutment ring 4 and fills the chamber below the movable stopper 6*b*. The downward movement of the shaft 5*a* presses the stopper 6*b* downwards and reduces the volume of the chamber thus regulating the ink flow toward the brush tip.

What is claimed is:

1. A brush-pen of round and flat hair and permanent liquid ink with adjustable flow for drawing and writing, comprising a cylindrical ink container having on one end a threaded removable cap for refueling and on the other end a ferrule with a brush tip, a passage for ink flow from the ink container through the ferrule to the brush tip including a stopper adjacent said ferrule and adapted to vary the passage through said ferrule in response to the position of said stopper relative to said ferrule, a shaft extending from said cap through said ink container and connected to said stopper, means for biasing said shaft into pressure contact with said cap, a freely movable hollow piston carried adjacent said stopper and cooperating in abutting relation with said biasing means, said hollow piston being movable axially within said cylindrical ink container against said biasing means in response to the axial shaking of the brush-pen to thereby clear dried ink from the interior of the ink container and means on said cap for selectively moving said shaft and thereby positioning said stopper relative to said ferrule in response to rotation of said cap so as to vary the ink passage through said ferrule to said brush tip.

2. The brush-pen of claim 1 wherein said ink container comprises a hollow cylinder threaded at both ends thereof, said brush-pen further including a hollow cylindrical member attached to said ink container through threads thereon which mesh with the threads on said ink container, said ferrule being mounted at one end of said cylindrical member, the other end of said member having a winged cap inserted therein, said winged cap having a tubular orifice centrally therethrough to guide said shaft, said freely movable, hollow piston being carried interiorly of said cylindrical member, said shaft extending through said hollow piston.

3. The brush-pen of claim 1 including a hollow cylindrical member at said other end of said ink container, said ferrule being mounted in one end of said cylindrical member, said freely movable, hollow piston being carried interiorly of said cylindrical member, a cylindrically wound spring within said cylindrical member, said shaft extending through the interior of said spring, one end of the spring adjacent said ferrule abutting an interior, circumferential surface of the piston and the other end of the spring being fixed to said shaft, said stopper including a filament extending longitudinally outwardly therefrom into the passage in said ferrule.

4. The brush-pen of claim 1 wherein said stopper includes a filament extending longitudinally outwardly therefrom, through said passage in said ferrule and into contact with said brush tip.

5. The brush-pen of claim 2 wherein said stopper includes a filament extending longitudinally outwardly therefrom, through said passage in said ferrule and into contact with said brush tip.

6. The brush-pen of claim 5 wherein said moving means on said cap comprises a threaded cylindrical member adapted to move into and out of said cap through the rotation thereof, said threaded cylindrical member being adapted to contact said shaft to thereby move said shaft longitudinally in response to rotation of said threaded cylindrical member.

7. The brush-pen of claim 1 wherein said moving means on said cap comprises a threaded cylindrical member adapted to move into and out of said cap through the rotation thereof, said threaded cylindrical member being adapted to contact said shaft to thereby move said shaft longitudinally in response to rotation of said threaded cylindrical member.

8. The brush-pen of claim 2 wherein said moving means on said cap comprises a threaded cylindrical member adapted to move into and out of said cap through the rotation thereof, said threaded cylindrical member being adapted to contact said shaft to thereby move said shaft longitudinally in response to rotation of said threaded cylindrical member.

* * * * *